US009982504B2

(12) United States Patent
Yokley et al.

(10) Patent No.: US 9,982,504 B2
(45) Date of Patent: May 29, 2018

(54) MECHANICAL HOLD-DOWN ASSEMBLY FOR A WELL TIE-BACK STRING

(71) Applicant: Dril-Quip, Inc., Houston, TX (US)

(72) Inventors: John M. Yokley, Kingwood, TX (US); Frank David Kalb, Cypress, TX (US); Curtis Wyatt Payne, Richmond, TX (US)

(73) Assignee: Drill-Quip, Inc., Houston, TX (US)

( * ) Notice: Subject to any disclaimer, the term of this patent is extended or adjusted under 35 U.S.C. 154(b) by 159 days.

(21) Appl. No.: 14/800,273

(22) Filed: Jul. 15, 2015

(65) Prior Publication Data

US 2016/0017687 A1 Jan. 21, 2016

Related U.S. Application Data

(60) Provisional application No. 62/025,380, filed on Jul. 16, 2014.

(51) Int. Cl.

| | |
|---|---|
| ***E21B 33/04*** | (2006.01) |
| ***E21B 33/038*** | (2006.01) |
| ***E21B 33/129*** | (2006.01) |
| ***E21B 33/043*** | (2006.01) |

(52) U.S. Cl.
CPC ..... *E21B 33/043* (2013.01); *E21B 33/038* (2013.01)

(58) Field of Classification Search
CPC ..... E21B 33/04; E21B 33/038; E21B 33/129
See application file for complete search history.

(56) References Cited

U.S. PATENT DOCUMENTS

| | | | | |
|---|---|---|---|---|
| 4,106,565 | A * | 8/1978 | Braddick | E21B 23/06 166/118 |
| 4,982,795 | A * | 1/1991 | King | E21B 33/0422 166/208 |
| 5,311,947 | A * | 5/1994 | Kent | E21B 33/043 166/348 |
| 6,761,221 | B1 * | 7/2004 | Yokley | E21B 23/01 166/118 |
| 2004/0113426 | A1 * | 6/2004 | Milberger | E21B 33/038 285/330 |
| 2013/0299176 | A1 | 11/2013 | Yokley et al. | |
| 2014/0151064 | A1 | 6/2014 | Kalb et al. | |

OTHER PUBLICATIONS

Search report in UK Application No. GB1512379.7, dated Dec. 4, 2015, 3 pages.

* cited by examiner

*Primary Examiner* — Cathleen R Hutchins
(74) *Attorney, Agent, or Firm* — Baker Botts L.L.P.

(57) ABSTRACT

An improved hold-down assembly for a well tie-back string and methods of use of the same are disclosed. The improved hold-down assembly includes a tie-back string and a hold-down assembly coupled to the tie-back string. The hold-down assembly includes one or more slips and a packer assembly disposed about the tie-back string.

20 Claims, 7 Drawing Sheets

MECHANICAL HOLD-DOWN ASSEMBLY FOR A WELL TIE-BACK STRING

BACKGROUND

The present disclosure relates generally to subsea well tie-backs and, more particularly, to a hold-down assembly for a well tie-back string.

In drilling or production of an offshore well, a riser may extend between a vessel or platform at the surface and a subsea wellhead. Auxiliary lines, such as choke, kill, and/or boost lines, may extend along the side of the riser to connect with the wellhead so that fluids may be circulated downwardly into the wellhead for various purposes. A tie-back connector may be used to couple the riser to the subsea wellhead.

The tie-back connector is coupled via the wellhead to a tie-back string downhole. Typically, the tie-back string is anchored using cement or hydraulic cylinders actuating a hold-down mechanism whose parts are above the primary seal. In certain applications, however, cement may not provide sufficient load-bearing capacity. Additionally, hydraulic cylinders above the primary seal presents a risk of undesirable leakage.

BRIEF DESCRIPTION OF THE DRAWINGS

Some specific exemplary embodiments of the disclosure may be understood by referring, in part, to the following description and the accompanying drawings.

FIG. 2 depicts a tie-back with a hold-down assembly in the locked configuration tripping through a borehole, according to aspects of the present disclosure.

FIG. 3 depicts unlocking the hold-down assembly from the tie-back string, according to aspects of the present disclosure.

FIG. 4 depicts setting the hold-down assembly against a casing, according to aspects of the present disclosure.

FIG. 5 depicts the tie-back string after shearing all shearing bolts, according to aspects of the present disclosure.

FIG. 6 depicts the tie-back string in the stretched position, according to aspects of the present disclosure.

FIG. 7 depicts setting an annular seal, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to subsea well tie-backs and, more particularly, to a hold-down assembly for a well tie-back string.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be used with any well head system. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

The terms "couple" or "couples," as used herein are intended to mean either an indirect or direct connection. Thus, if a first device couples to a second device, that connection may be through a direct connection, or through an indirect connection via other devices and connections. Further, if a first device is "fluidically coupled" to a second device there may be a direct or an indirect flow path between the two devices. The term "uphole" as used herein means along the drillstring or the hole from the distal end towards the surface, and "downhole" as used herein means along the drillstring or the hole from the surface towards the distal end. However, the use of the terms "uphole" and "downhole" is not intended to limit the present disclosure to any particular wellbore configuration as the methods and systems disclosed herein may be used in conjunction with developing vertical wellbores, horizontal wellbore, deviated wellbores or any other desired wellbore configurations.

Figure 1:
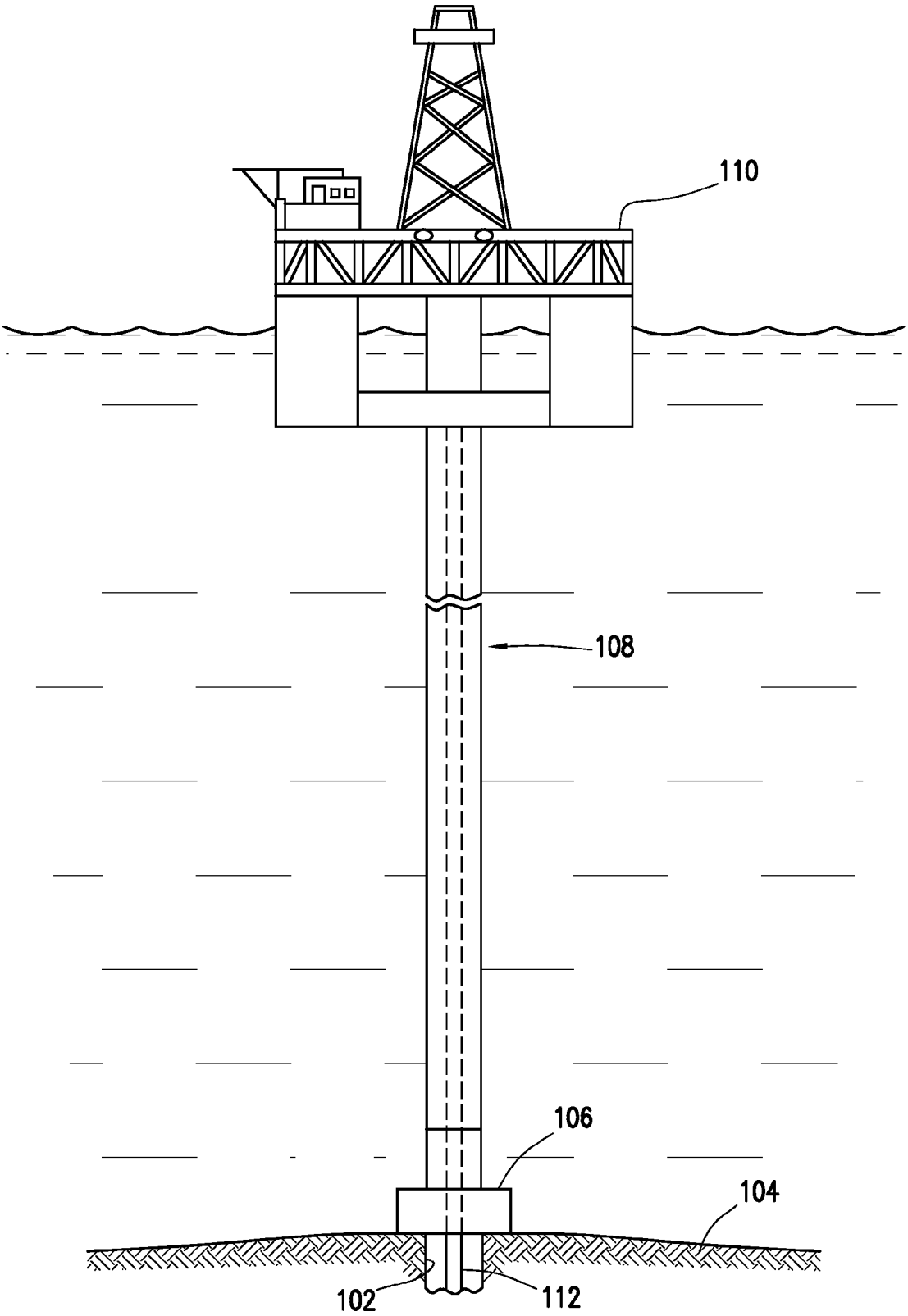
FIG. 1 is an illustration depicting a system for performance of subsea subterranean operations, according to aspects of the present disclosure.

FIG. 1 depicts an illustrative system for performing subsea subterranean operations. In certain illustrative implementations, a wellbore 102 may be drilled into a subterranean formation 104. A wellhead 106 may be placed on the sea floor at an uphole terminal end of the wellbore 102. A riser 108 may then fluidically couple the wellhead 106 to the platform 110 to facilitate fluid flow between the wellhead 106 and the platform 110. Specifically, as shown in FIG. 1, a first terminal end of the riser 108 may be coupled to the platform and a second terminal end of the riser 108 may be coupled to the wellhead 106. A production pipe or a drilling pipe 112 may be inserted into the wellbore 102. Accordingly, fluids may flow between the platform 110 and the subterranean formation 104 through the riser 108, the wellhead 106 and the production pipe or the drilling pipe 112. It is desirable to provide a fluid flow path between the subterranean formation 104 and the platform 110 that permits efficient fluid flow between the two.

Figure 2:
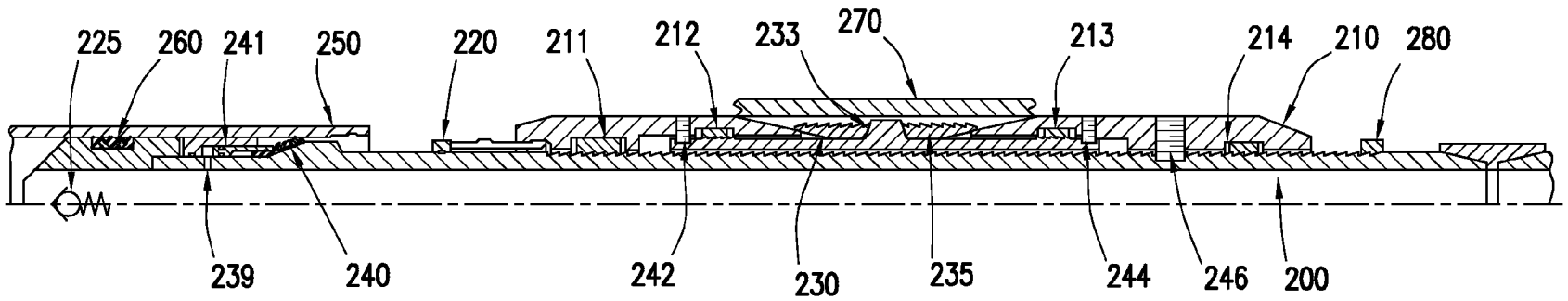
FIGS. 2-7 are illustrations depicting a sequence of steps in a mechanical hold-down assembly for a well tie-back string method, according to aspects of the present disclosure.

FIGS. 2-7 depict a sequence of steps for mechanically holding down a tie-back string 200 with a hold-down assembly 210. FIG. 2 depicts the tie-back string 200 tripping through a borehole (such as borehole 102 of FIG. 1) with the hold-down assembly 210 in a locked configuration.

In certain embodiments, a tie-back receptacle 250 may be set downhole before the tie-back string 200 is introduced into the borehole. As discussed further below with respect to FIG. 3, the tie-back receptacle 250 may be adapted to interface with a locking mechanism 220 in order to unlock the hold-down assembly 210. In alternative embodiments a polished bore receptacle may be used instead of tie-back receptacle 250.

Tie-back string 200 may optionally include an inverted valve 225 that may be controlled by the wellsite operator to open or close (permitting or blocking fluid conductivity between tie-back string 200 and the borehole). In alternative embodiments, other types of devices may be used, such as a ball valve or downhole ball seat.

Hold-down assembly 210 may include bi-directional slips. In the embodiment of FIG. 2, for example, hold-down assembly 210 is shown to comprise two slips 230 and 235 located on either side of a frusto-conical surface 233. In certain implementations, the slips 230 and 235 may be slip assemblies. For instance, in certain implementations, the slips 230 and 235 may be the slip assemblies disclosed in U.S. Pat. No. 6,761,221, which is incorporated herein by reference in its entirety. As discussed below with respect to FIG. 4, the slips 230 and 235 may slide up the frusto-conical surface 233, causing their teeth to bite into well casing 270 and permitting the weight of tie-back string 200 to be hung off on the well casing 270. In alternative embodiments, different bi-directional slip assemblies may be used, including one-piece slip assemblies. As would be appreciated by those of ordinary skill in the art, having the benefit of the present disclosure, the present methods and systems are not limited to any particular type of slips. Accordingly, the slips 230 and 235 may be any suitable slip type known to those of ordinary skill in the art, without departing from the scope of the present disclosure.

In certain implementations, the tie-back string 200 may include an annular seal assembly. In the illustrative embodiment of FIG. 2, for example, the annular seal assembly may be a packer assembly 240. In certain embodiments, the packer assembly 240 may be a metal-to-metal seal. An illustrative metal-to-metal seal that may be used as the packer assembly 240 is disclosed in U.S. Pat. No. 6,666,276, which is incorporated herein by reference in its entirety. As discussed further with respect to FIG. 7, the packer assembly 240 may be set in at least one of two ways: mechanically or hydraulically. As would be appreciated by those of ordinary skill in the art, having the benefit of the present disclosure, the present methods and systems are not limited to any particular type of annular seal assembly. Accordingly, the seal assembly may be any suitable seal assembly type known to those of ordinary skill in the art, without departing from the scope of the present disclosure.

In certain embodiments, one or more latch rings may couple the hold-down assembly 210 to the tie-back string 200. In the illustrative embodiment of FIG. 2, four latch rings 211, 212, 213, and 214 are shown, all of which use a one-way ratchet interface. The one-way ratchet interface may allow the tie-back string 200 to move downhole relative to the hold-down assembly 210 when the hold-down assembly 210 has been unlocked (but the one-way ratchet prevents the tie-back string 200 from moving uphole). In this way, the embodiment of FIG. 2 may be configured to permit ratcheting of the tie-back string 200 in the downhole direction (relative to the hold-down assembly 210) during the steps of setting the hold-down assembly 210 and the annular seal assembly 240, as discussed further with respect to FIGS. 3-7. A no-go landing ring 280 is shown coupled to the tie-back string 200 uphole from the hold-down assembly 210. As discussed below with respect to FIGS. 6 and 7, the no-go landing ring 280 may set a limit on the relative downhole movement of tie-back string 200. As would be appreciated by those of ordinary skill in the art, having the benefit of the present disclosure, however, the present methods and systems are not limited to the use of latch rings with a racheting configuration.

In certain embodiments, the tie-back string 200 may have features adapted to indicate to wellsite operators the relative position of the tie-back string 200 downhole. In the embodiment of FIG. 2, for example, the tie-back string 200 is shown to include v-packing 260. During stab-in of the tie-back string 200, with fluid circulation through the tie-back string 200, v-packing 260 will generate an increase in downhole pressure when it intersects the tie-back receptacle 250. By monitoring for the increase in pressure, a wellsite operator may identify the position of the tie-back string 200 relative to the tie-back receptacle 250 and, in particular, know that the tie-back string 200 is in position to begin steps for unlocking the hold-down assembly 210. In FIG. 2, the tie-back string 200 has already been stabbed into the tie-back receptacle 250 past the threshold of the v-packing 260 but the hold-down assembly 210 has not yet been unlocked.

After the initial stab-in, a wellsite operator may use positioning information (e.g., information from the v-packing 260 about distance to the tie-back receptacle 250) to assist with spacing out a wellhead casing hanger sealing assembly. Additionally, the use of the latch ring 214 (with a one-way ratchet interface) and the no-go landing ring 280 may assist in spacing out and landing the wellhead casing hanger sealing assembly. For example, the wellsite operator may adjust the distance between the no-go landing ring 280 and the top of hold-down assembly 210 to provide a desired margin-of-error for the space-out measurement.

In accordance with certain embodiments of the present disclosure, the improved hold-down assembly may include one or more shear bolts. In the illustrative embodiment of FIG. 2, three shear bolts 242, 244, and 246 are provided. The shear bolts 242, 244, and 246 may have any desirable shear strengths. The shear strengths of the different shear bolts 242, 244, and 246 may be the same or may be different depending on the operator's preferences. For instance, in one embodiment, each of the three shear bolts may have different shear strengths (e.g., 50,000 pounds; 100,000 pounds; and 200,000 pounds, respectively). As discussed below with respect to FIGS. 4-6, the shear bolts 242, 244, and 246 may be used by the wellsite operator to identify the setting process of the hold-down assembly 210 and the relative downhole position of the tie-back string 200. In particular, the wellsite operator may successively shear each of the shear bolts 242, 244, and 246 through application of sufficient shearing force before, respectively, setting slip 230, slip 235, and shearing the tie-back string 200 from the hold-down assembly 210.

Figure 3:
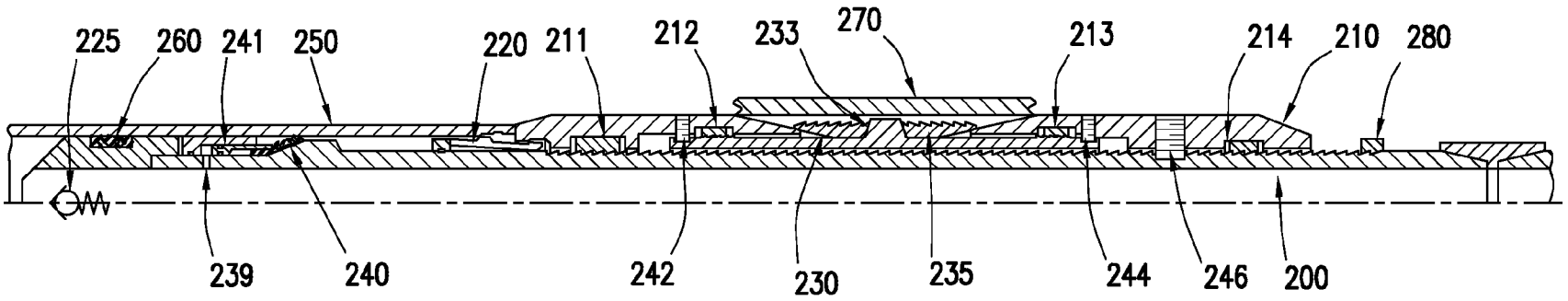

FIG. 3 depicts the tie-back string 200 of FIG. 2 with the hold-down assembly 210 in the unlocked position. In the illustrative embodiment of FIG. 3, the wellsite operator may have slacked off the tie-back string 200 such that the tie-back receptacle 250 unlocks the locking mechanism 220. An exemplary locking mechanism 220 is shown in FIG. 3 as a latch that locks into the hold-down assembly 210. In such an embodiment, the tie-back receptacle 250 may operate by collapsing the latch and thus unlocking the hold-down assembly 210. As would be appreciated by those of ordinary skill in the art, having the benefit of the present disclosure, the present methods and systems are not limited to any particular type of locking mechanism. Accordingly, the locking mechanism may be any suitable locking mechanism type known to those of ordinary skill in the art, without departing from the scope of the present disclosure.

Figure 4:
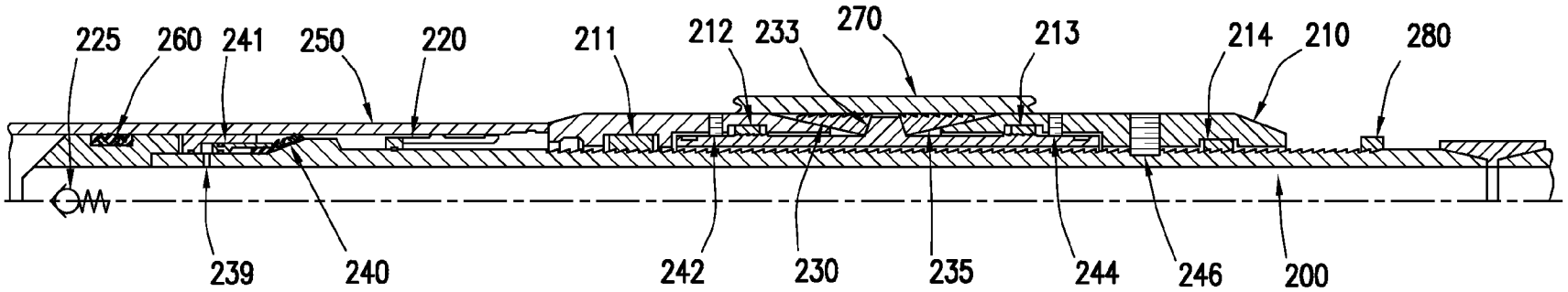

FIG. 4 depicts the tie-back string 200 of FIG. 3 with the hold-down assembly 210 set against the casing 270. As shown in FIG. 4, the tie-back string 200 includes shear bolts 242, 244, and 246 that may be used by the wellsite operator for monitoring the relative downhole position of tie-back string 200 and to separately set the slips 230 and 235. In certain embodiments, the shear bolt 242 may have a lower shear strength than the shear bolt 244; by slacking off and applying a shearing force above the strength of the shear bolt 242 (but below the shear bolt 244), the wellsite operator may shear only the shear bolt 242 and then set the slip 230 by sliding it up frusto-conical surface 233. Similarly, the shear bolt 244 may have a lower shear strength than the shear bolt 246, such that the wellsite operator may next slack off to apply a sufficient force to shear only the shear bolt 244 and then set slip 235 using frusto-conical surface 233.

After setting the slips 230 and 235, the wellsite operator may pull-up and slack-off the tie-back string 200 several times to ensure that the slips 230 and 235 are sufficiently anchored into casing 270. Although the embodiment of FIG. 4 depicts the use of two separate slip assemblies, a single bi-directional assembly may be used.

Figure 5:
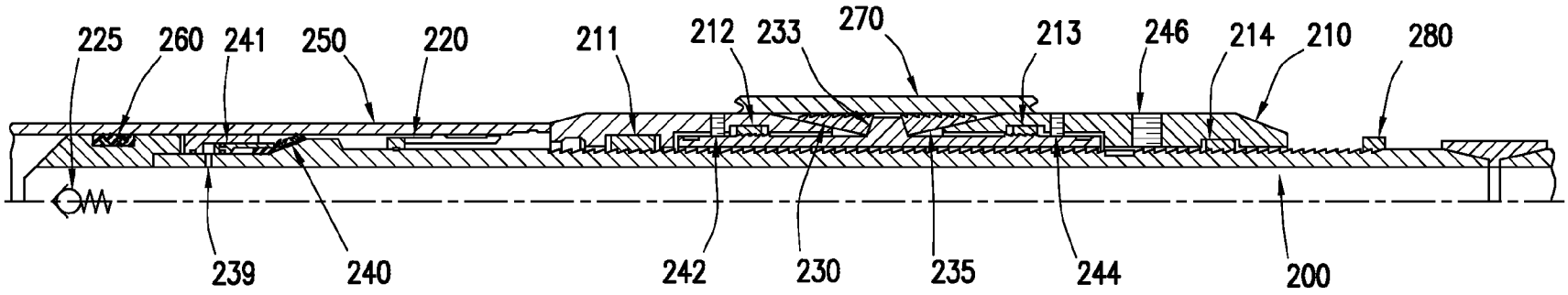

FIG. 5 depicts the tie-back string 200 of FIG. 4 after the wellsite operator has slacked off and applied sufficient force to shear the shear bolt 246. In certain embodiments, once the tie-back string 200 is sheared from the hold-down assembly 210, the wellsite operator may land the wellhead casing hanger sealing assembly uphole.

Figure 6:
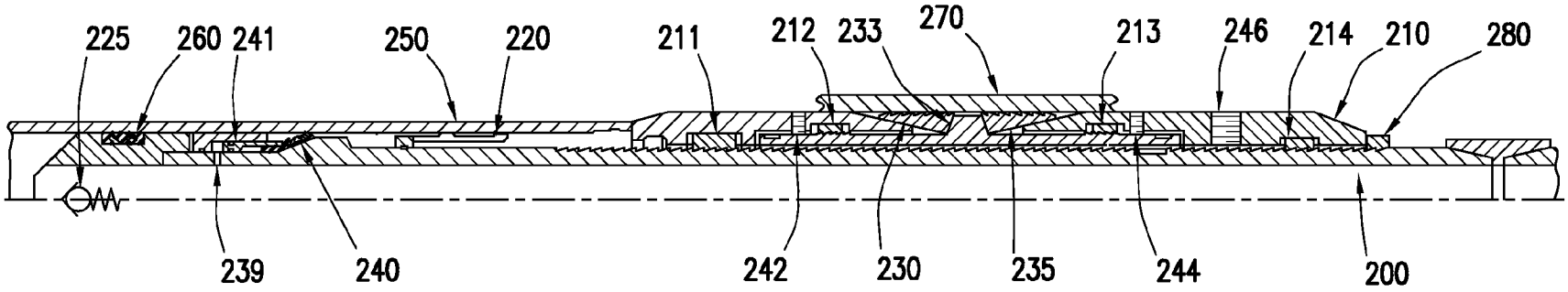

FIG. 6 depicts the tie-back string 200 of FIG. 5 in the stretched position. In certain embodiments, after the tie-backstring 200 is sheared from the hold-down assembly 210 as in FIG. 5, the wellsite operator may then begin stretching the tie-back string 200 (i.e., putting it into tension), for example by closing the inverted valve 225 and pumping fluid to increase the pressure down the tie-back string 200. As the tie-back string 200 stretches, it will move downhole relative to the hold-down assembly 210 through the one-way ratchet of latch ring 214. In FIG. 6, the tie-back string 200 has been stretched until the no-go ring 280 lands at the top of the hold-down assembly 210. In certain embodiments, the position of the no-go ring 280 on the tie-back string 200 may be adjustable at the surface wellsite. In this way, the desired amount of stretch of the tie-back string 200 may be set based on up-to-date casing parameter measurements as desired by the wellsite operator. As a result, tension is trapped by stretching the tie-back string 200 with the slips 230, 235 anchored into the casing 270. Accordingly, the disclosed mechanism provides a primary hold-down function and the trapped tension must be overcome to undo this primary hold-down.

The latch ring 214 coupling the hold-down assembly 210 to the tie-back string 200 may be configured to withstand substantial loads (e.g., loads greater than 2,000,000 lbs) in order to maintain the desired tension on the tie-back string 200 as well as the relative placement of tie-back string 200 to hold-down assembly 210. Maintaining tension on the tie-back string 200 provides several advantages. For example, maintaining tension on the tie-back string 200 may advantageously increase the collapse capacity of the tie-back string 200, lower its risk of corkscrewing, and apply induced loads on the hold-down assembly 210 rather than the wellhead.

Figure 7:
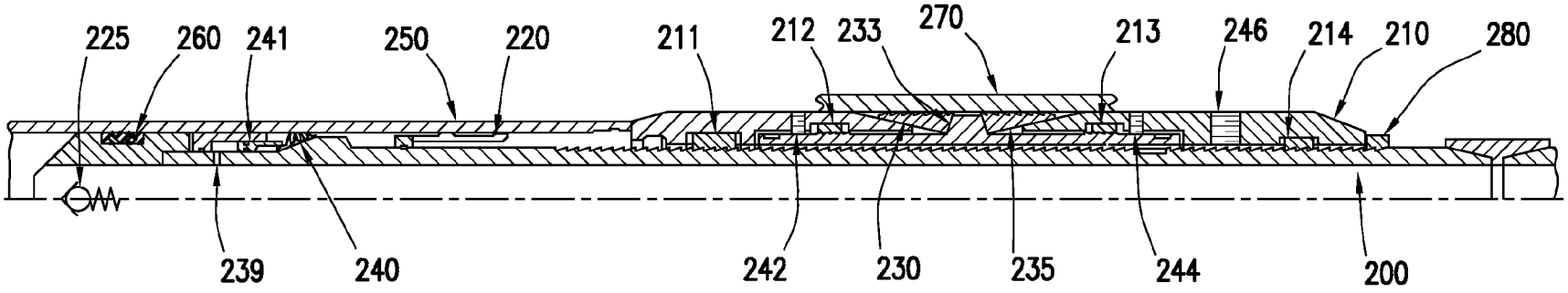

FIG. 7 depicts the tie-back string 200 of FIG. 6 with an annular seal. In the embodiment of FIG. 7, the annular seal is formed by setting a packer assembly 240, which may create a metal-to-metal seal. The packer assembly 240 may be set in at least one of two ways: hydraulically or mechanically. In certain embodiments of a mechanical configuration, a trip may be made through the borehole with a packer setting tool adapted to set the packer assembly 240. In certain embodiments of a hydraulic configuration, tie-back string 200 may include a packer setting port 239 that may be operated to allow fluid to flow through an optional packer setting piston 241 into the packer assembly 240 so as to set the packer assembly 240 and create an annular seal. In either configuration, the strength of the seal may then be tested by the wellsite operator.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A mechanical hold-down assembly for a well tie-back string comprising:

a tie-back string;

a hold-down assembly coupled to the tie-back string, wherein the hold-down assembly comprises one or more slips, and wherein setting the one or more slips couples the tie-back string to a casing; and a packer assembly disposed about the tie-back string, wherein the packer assembly comprises an annular seal disposed downhole from the hold-down assembly;

wherein the hold-down assembly further comprises:

one or more latch rings coupling the one or more slips to a main body of the hold-down assembly; and one or more shear bolts coupled between the one or more slips and the main body, wherein shearing of the one or more shear bolts allows the one or more slips to move relative to the main body via the one or more latch rings to set the one or more slips as the tie-back string moves relative to the hold-down assembly.

2. The mechanical hold-down assembly of claim 1, wherein the one or more slips comprise bi-directional slips.

3. The mechanical hold-down assembly of claim 1, wherein the hold-down assembly comprises a frusto-conical surface and wherein the one or more slips are operable to slide up the frusto-conical surface.

4. The mechanical hold-down assembly of claim 1, wherein the one or more slips are operable to be set against a casing to couple the tie-back string to the casing, and wherein the packer assembly is operable to seal an annular space between the tie-back string and a downhole tool disposed within the casing.

5. The mechanical hold-down assembly of claim 1 further comprising one or more latch rings, wherein the one or more latch rings couple the hold-down assembly to the tie-back string.

6. The mechanical hold-down assembly of claim 1 further comprising a no-go landing ring, wherein the no-go landing ring limits a relative downhole movement of the tie-back string as the tie-back string is stretched in response to pressure within the tie-back string.

7. The mechanical hold-down assembly of claim 1, wherein tension is trapped by stretching the tie-back string.

8. The mechanical hold-down assembly of claim 1, wherein the hold-down assembly further comprises:

one or more additional latch rings coupling the hold-down assembly directly to the tie-back string; and one or more additional shear mechanisms coupling the hold-down assembly directly to the tie-back string, wherein shearing of the one or more additional shear mechanisms allows the tie-back string to move relative to the hold-down assembly.

9. The mechanical hold-down assembly of claim 1, wherein the one or more slips are mechanically set slips.

10. A method for holding down a well tie-back string comprising:

tripping a tie-back string into a well, wherein said tie-back string is coupled to a hold-down assembly comprising one or more slips;

setting said one or more slips of the hold-down assembly against a casing, wherein setting the one or more slips couples the tie-back string to the casing; and creating an annular seal downhole from said one or more slips via a packer assembly disposed downhole from the hold-down assembly;

wherein setting the one or more slips comprises:

shearing one or more shear bolts coupled between the one or more slips and a main body of the hold-down assembly; and allowing the one or more slips to move relative to the main body via one or more latch rings coupling the one or more slips to the main body as the tie-back string moves relative to the hold-down assembly.

11. The method of claim 10 further comprising unlocking the hold-down assembly, wherein unlocking the hold-down assembly comprises interfacing a tie-back receptacle with a locking mechanism on the hold-down assembly.

12. The method of claim 10, wherein the one or more shear bolts comprise a plurality of shear bolts, wherein the plurality of shear bolts have different shear strengths.

13. The method of claim 10, wherein setting the one or more slips comprises sliding the one or more slips up a frusto-conical surface.

14. The method of claim 10 further comprising selectively permitting fluid conductivity between the tie-back string and a borehole.

15. The method of claim 10, wherein one or more additional latch rings couple the hold-down assembly to the tie-back string.

16. The method of claim 10 further comprising limiting a relative downhole movement of the tie-back string using a no-go landing ring as the tie-back string is stretched in response to pressure within the tie-back string.

17. The method of claim 10 further comprising trapping tension by stretching the tie-back string.

18. The method of claim 10, further comprising:

shearing one or more additional shear bolts coupled between the hold-down assembly and the tie-back string after setting the one or more slips; and allowing the tie-back string to move relative to the hold-down assembly via one or more additional latch rings coupling the tie-back string to the hold-down assembly in response to force on the tie-back string.

19. The method of claim 10, further comprising:

shearing one or more additional shear bolts coupled between the hold-down assembly and the tie-back string after setting the one or more slips;

allowing the tie-back string to move relative to the hold-down assembly in response to force on the tie-back string; and landing a wellhead casing hanger sealing assembly coupled to the tie-back string at an uphole location in response to the movement of the tie-back string.

20. The method of claim 10, wherein creating an annular seal comprises sealing an annular space between the tie-back string and a downhole tool positioned in the casing via the packer assembly.

* * * * *